US007665593B2

(12) United States Patent
Hansson

(10) Patent No.: US 7,665,593 B2
(45) Date of Patent: Feb. 23, 2010

(54) CASH-HANDLING DEVICE

(75) Inventor: Lars-Åke Hansson, Mellösa (SE)

(73) Assignee: Gunnebo Cash Automation AB, Göteborg (SE)

( * ) Notice: Subject to any disclaimer, the term of this patent is extended or adjusted under 35 U.S.C. 154(b) by 13 days.

(21) Appl. No.: 11/662,130

(22) PCT Filed: Sep. 7, 2005

(86) PCT No.: PCT/SE2005/001286

§ 371 (c)(1),
(2), (4) Date: Mar. 7, 2007

(87) PCT Pub. No.: WO2006/041357

PCT Pub. Date: Apr. 20, 2006

(65) Prior Publication Data

US 2008/0073177 A1 Mar. 27, 2008

(30) Foreign Application Priority Data

Sep. 8, 2004 (SE) ..... 0402142

(51) Int. Cl.
*G07D 11/00* (2006.01)

(52) U.S. Cl. ..... 194/344; 194/350

(58) Field of Classification Search ..... 193/30
See application file for complete search history.

(56) References Cited

U.S. PATENT DOCUMENTS 4,193,511 A * 3/1980 Taber ..... 221/66
5,295,942 A * 3/1994 Franklin ..... 493/302
6,112,504 A * 9/2000 McGregor et al. ..... 53/417
6,712,219 B2 * 3/2004 Kobayashi et al. ..... 209/534
6,763,924 B2 * 7/2004 Olbrich ..... 194/217
7,185,740 B2 * 3/2007 Beskitt et al. ..... 186/37
2006/0010837 A1 * 1/2006 Jurus ..... 53/436
2008/0135608 A1 * 6/2008 Ireland et al. ..... 232/1 D

FOREIGN PATENT DOCUMENTS

| | | |
|---|---|---|
| EP | 0 004 436 A1 | 10/1979 |
| EP | 1 369 826 A1 | 12/2003 |
| GB | 2 352 006 B | 1/2001 |
| WO | WO 02/19289 A2 | 3/2002 |

* cited by examiner

*Primary Examiner*—Patrick Mackey
*Assistant Examiner*—Mark Beauchaine
(74) *Attorney, Agent, or Firm*—Alfred J. Mangels

(57) ABSTRACT

The present invention relates to an arrangement (1) for packing banknotes (2) that are received in a closed cassette (3) which is capable of detachable attachment to an emptying machine (5). In accordance with the invention, a path leads from the emptying machine (5) for the transfer of banknotes (2)to a packing machine (6) for banknotes (2). The aforementioned packing machine (6) comprises a holder for supporting security bags and a banknote conveyor which comprises a casing capable of displacement relative to the bag holder and extending internally in the bag in question prepared for receiving. In order among other things to force out air from the bag, movable jaws arranged relative to one another are present, situated to either side of a bag receiving space, and the aforementioned jaws are so arranged as to drive a bag threaded around the case in a downwards direction.

9 Claims, 10 Drawing Sheets

CASH-HANDLING DEVICE

BACKGROUND OF THE INVENTION

1. Field of the Invention

The present invention relates to an arrangement for packing banknotes that are received in a closed cassette that is capable of detachable attachment to a banknote emptying machine.

2. Description of the Related Art

There are various more or less secure ways of handling banknotes when the question arises of being able to transport the banknotes from the shops and other places at which the money is received, especially in the retail trade. Previously disclosed is the use of so-called security bags made of plastic, which exhibit a closure of the kind which makes the bag impossible to open without the fact of opening being revealed in the course of a check. Security companies which take care of the transport in this case have full control over the content that is being transported. Problems are encountered, however, in respect of the ability to pack the banknotes in the bags, because packing has previously taken place manually. Certain machines exist, which enable bands to be passed around bundles of banknotes, such as one that is described in WO 00/26863.

Also previously disclosed through WO 02/19289 A2, EP 0004436 A2, GB 2352006 B, and EP 1369826 A1 are packing machines for banknotes and bag arrangements with a closure arrangement for the bags.

The principal object of the present invention is thus, in the first instance, among other things to solve the above-mentioned problems by simple and reliably functioning means and to permit the mechanical, automatic, secure packing of banknotes in security bags, wherein the banknotes are handled with the help of cassettes and without permitting access to the contents by any unauthorized persons.

SUMMARY OF THE INVENTION

The above-mentioned object is achieved by an arrangement in accordance with the present invention. A path leads from an emptying machine for the transfer of banknotes to a packing machine for banknotes. The packing machine includes a holder for supporting security bags. A banknote conveyor that includes a casing capable of displacement relative to the bag holder and extending internally into the bag in question prepared for receiving, is so arranged that the conveyor includes a casing. Jaws capable of displacement relative to one another are situated to either side of a bag receiving space. The jaws are in the form of two elongated rollers facing towards one another that are so arranged as to be capable of being driven relative to the bag.

BRIEF DESCRIPTION OF THE DRAWINGS

The invention is described below as a preferred illustrative embodiment, in conjunction with which reference is made to the accompanying drawings, in which.

DESCRIPTION OF THE PREFERRED EMBODIMENTS

Figure 1:
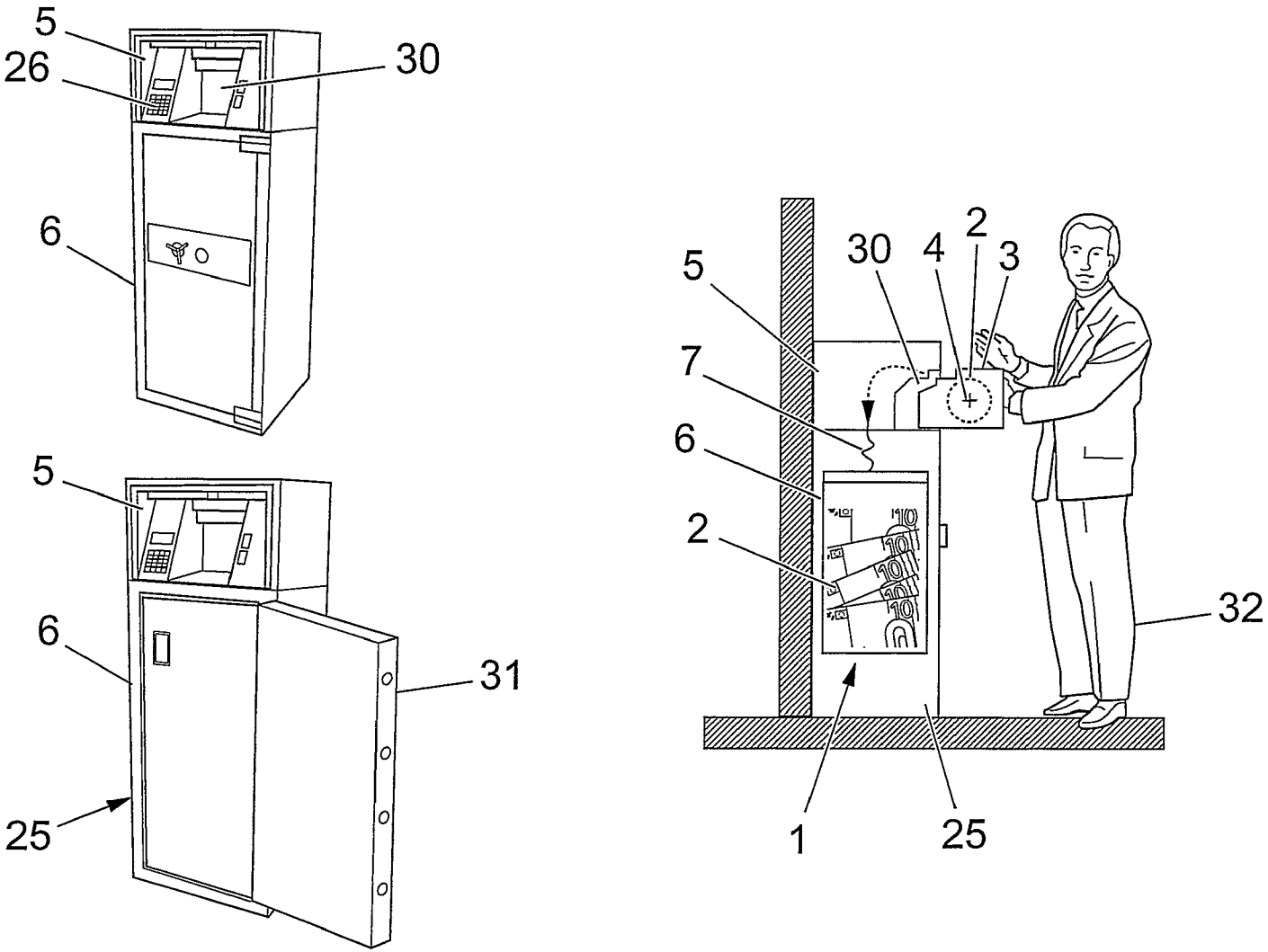
FIG. 1 shows the arrangement viewed from the outside from various directions.

FIG. 1 shows an arrangement 1 for packing banknotes 2 and other comparable valuable papers, which are received in a closed cassette 3 and are preferably wound onto a rotatably driven roller 4. The cassette is capable of detachable attachment to an emptying machine 5 in an appropriate emptying area 30 in the emptying machine 5. The emptying machine is connected to a packing machine 6.

Figure 2:
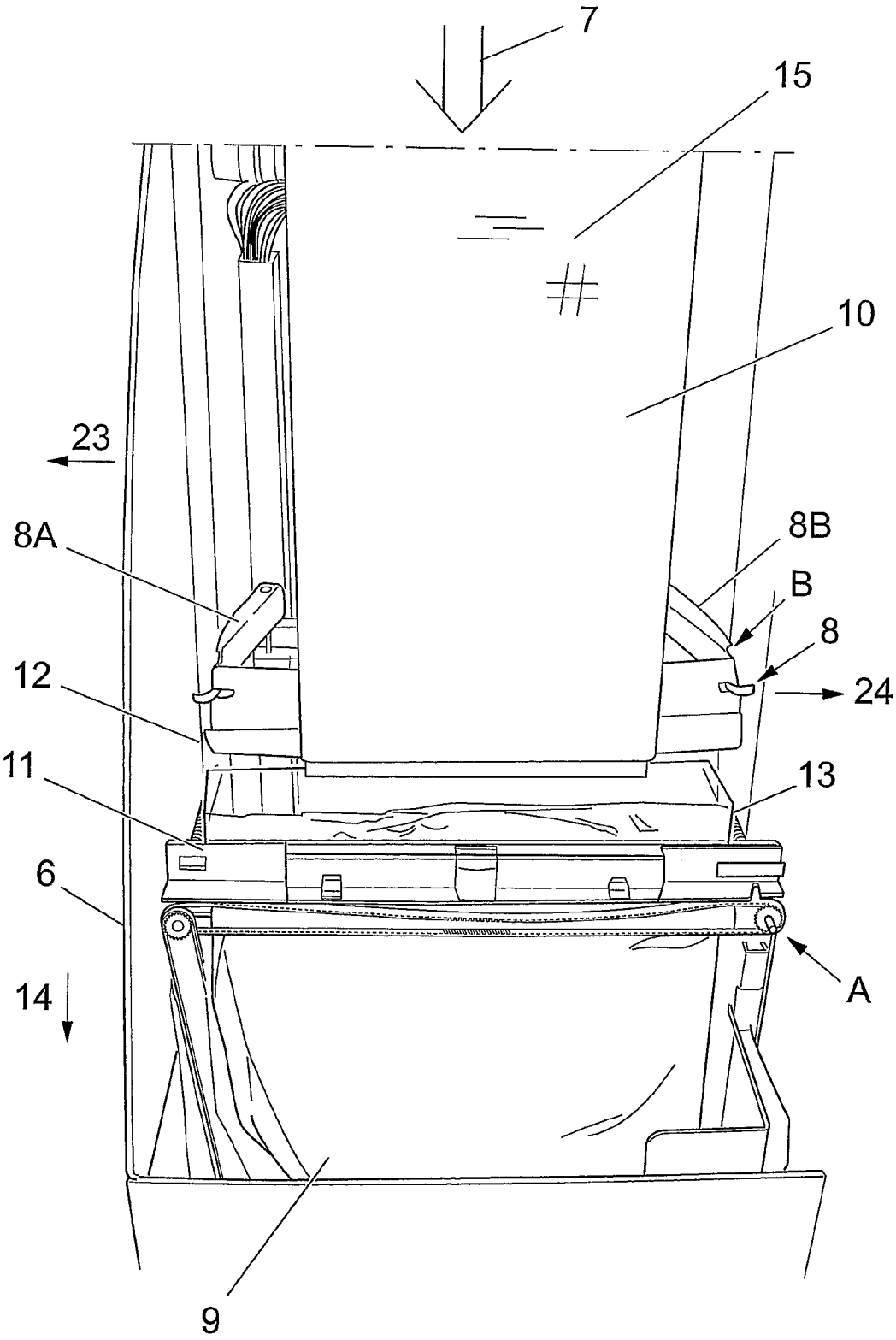
FIG. 2 shows a perspective view of the arrangement in an opened, final position for the removal of a bag.

In accordance with the present invention, a discharge path 7, which is arranged for the transfer of emptied banknotes 2, leads from emptying machine 5 to packing machine 6 for banknotes 2. As shown in FIG. 2, packing machine 6 includes a holder for supporting security bags 9, one at a time. A banknote chute 10 capable of displacement relative to the bag holder 8 is provided. The chute includes an outer casing, preferably of rectangular cross-sectional form, that is arranged to extend into a receiving bag 9 in preparation for filling of the bag with banknotes 2.

Two opposed jaws 11, 12 capable of movement toward and away from one another are situated to either side A, B of an intended bag receiving area 13. Jaws 11, 12 include rubber surface material and are so arranged as to be capable of being driven at right angles to the intended vertical extent 14 of the bag receiving region 13 relative to the bag 9.

Chute 10 is of a telescopic construction with flat sides 15, which are essentially parallel to one another in pairs, similar to a sword that is so arranged as to be fixed, while the bag 9 is able to move along the same.

The jaws 11, 12 include rollers that are mutually opposing and extend parallel to one another. The rollers are driven in such a way that they are caused to rotate in opposite directions relative to one another, and they are also driven in such a way that they are displaced in a horizontal direction 50. The driving of jaws 11, 12 is achieved through the interaction between toothed belts 16, 17, 18 and toothed wheels 19, 20, which belts 16-18 are preferably in the form of rubber and/or plastic belts. Driving of the belts takes place by means of a number of electrically driven motors (not shown) arranged internally within the packing machine 6. Driving of the jaw rollers 11, 12 causes the bag 9 to be influenced in such a way by the rollers 11, 12 as to be displaced in a direction respectively downwards 14 and upwards as the rollers are each rotating in opposite directions.

The security bags 9 that are used include an upper transverse strip 21 that is torn off along a perforation once the bag has been filled with banknotes of the intended quantity and denomination. The bag is then sealed automatically in the packing machine by the interaction of the jaws with one another. Holes 22 for that purpose are arranged in strip 21 at a mutual distance from one another.

As shown in FIG. 2, bag holder 8 includes bag retaining arms 8A, 8B or similar carriers, which include outer fingers capable of being introduced into the matching holes 22, and which, after filling and closing the bag 9, can permit the bag to be removed easily from the holder because at least one retaining arm 8A is pivotally mounted for movement in a lateral direction 23, 24. Retaining arms 8A, 8B are thus capable of displacement in a direction 23, 24 toward and away from one another, viewed in a relative sense.

Referring again to FIG. 1, emptying machine 5 with its associated bag receiving region 13 and packing machine 6 are enclosed in a lockable cabinet 25 equipped with a security door 31. Access to the interior of cabinet 25 is possible after the person 32, who has been entrusted with handling and emptying the cassette 3 in question, has entered a certain specific identification code via a keypad 26 or some other access code indicator connected to the machine 5, 6. The banknote-handling cassette 3, which is provided with a rotatably driven roller 4 for receiving banknotes 2, is attached in a lockable fashion to the emptying machine 5 when the cassette is to be emptied of its content of banknotes 2. The banknotes are then to be packed directly into a security bag 9 provided for the purpose.

Figure 3:
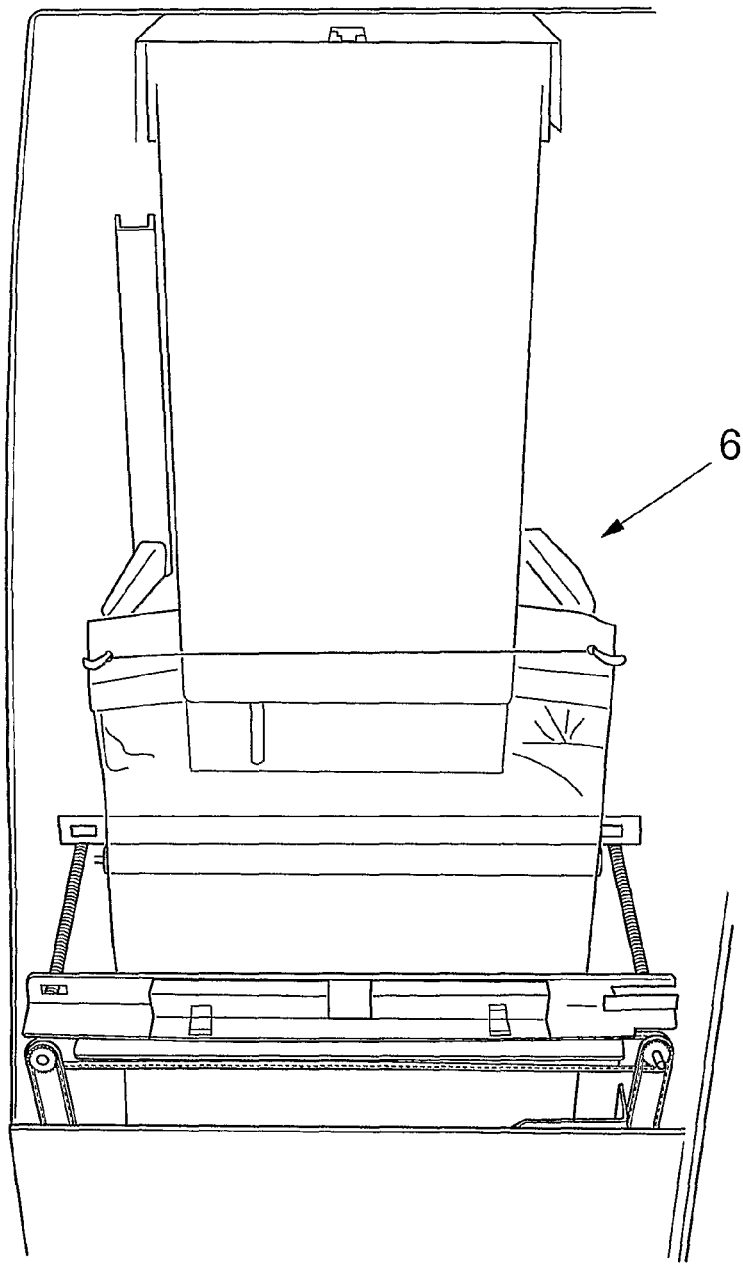
FIG. 3 shows a further perspective view of the arrangement in a position in which a bag is passed onto a holder.
Figure 4:
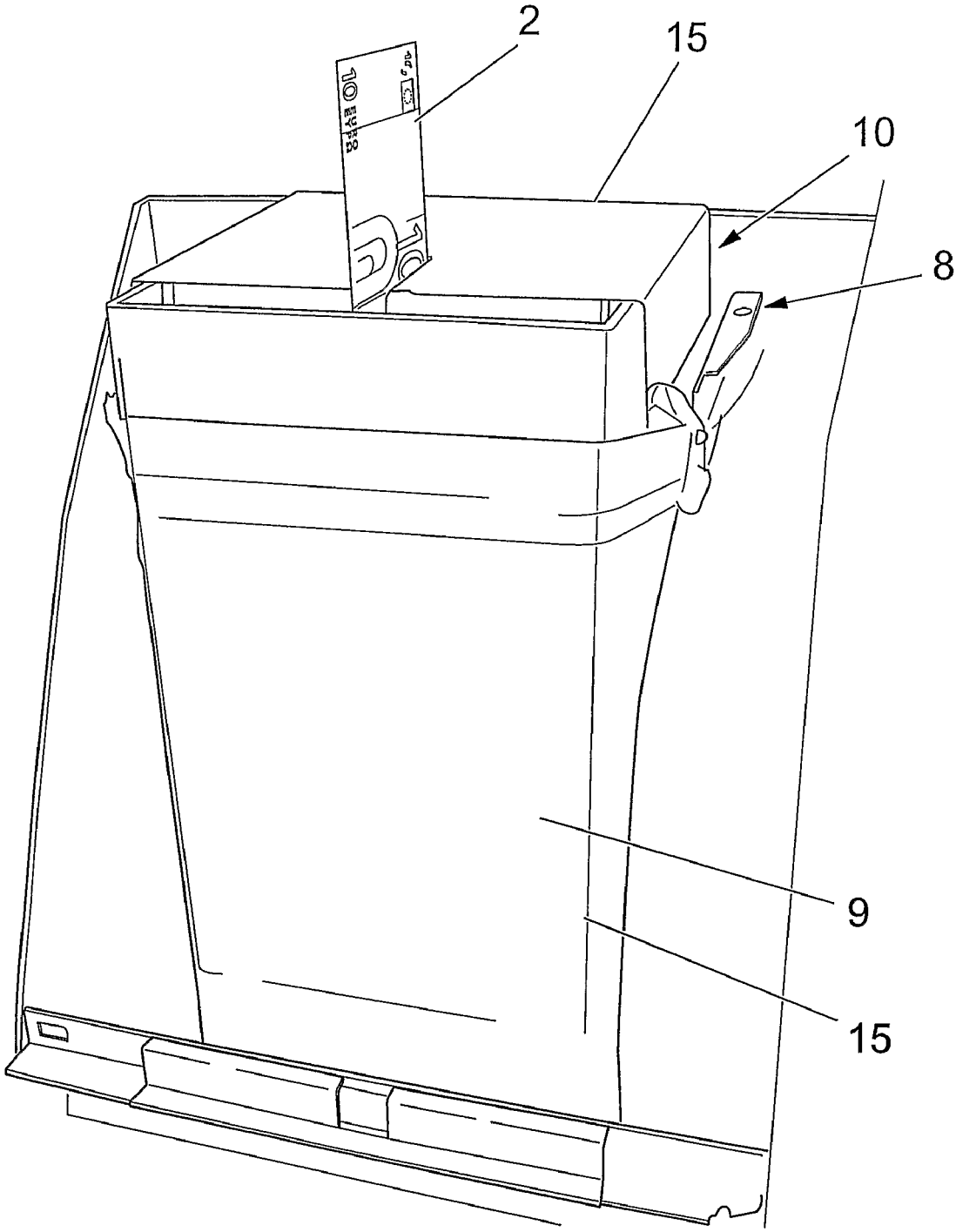
FIG. 4 shows a banknote in the process of being fed into the arrangement and its packing machine in the starting position for the feeding-in of banknotes.
Figure 5:
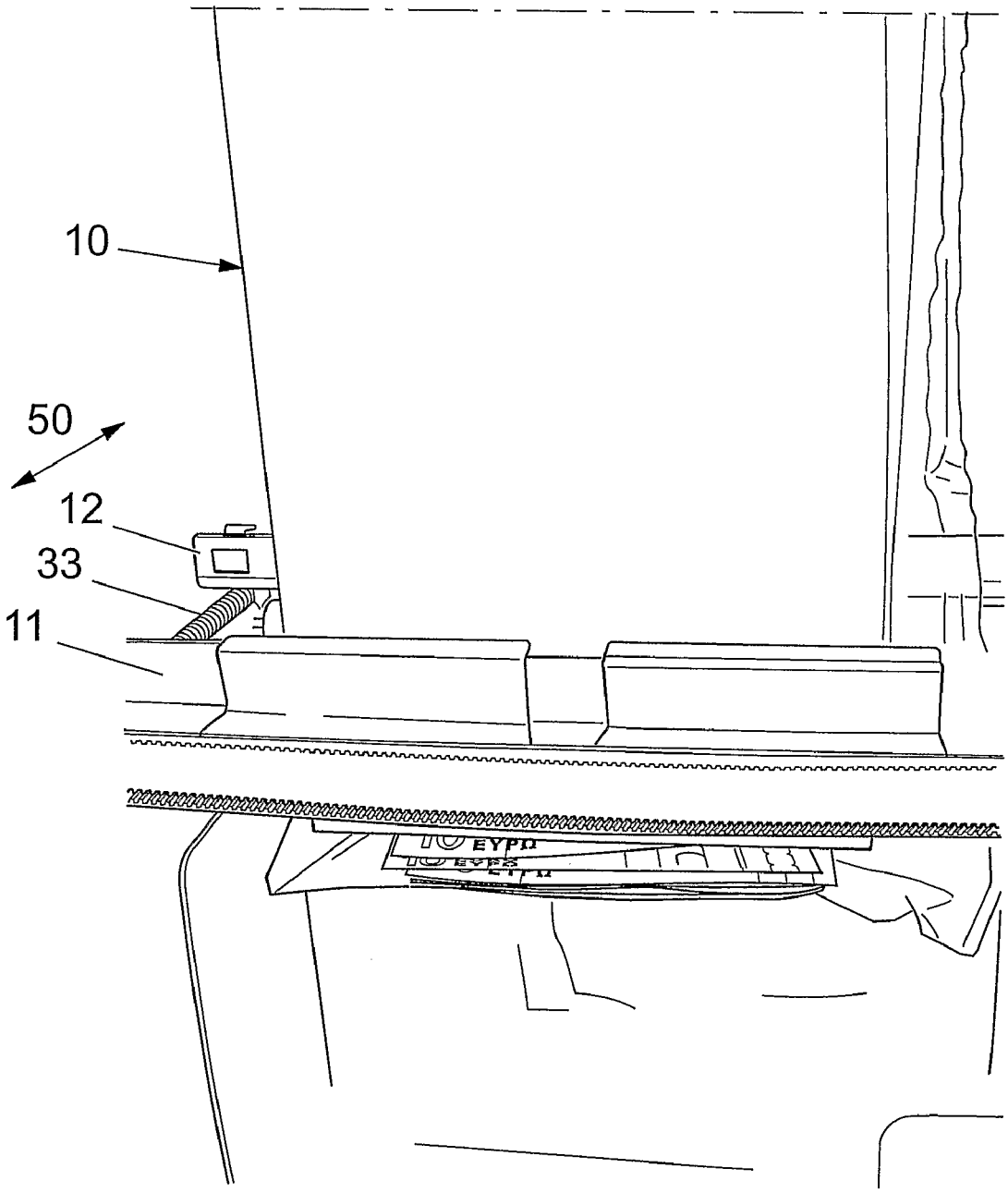
FIGS. 5-6 show the filling of notes into a bag.
Figure 6:
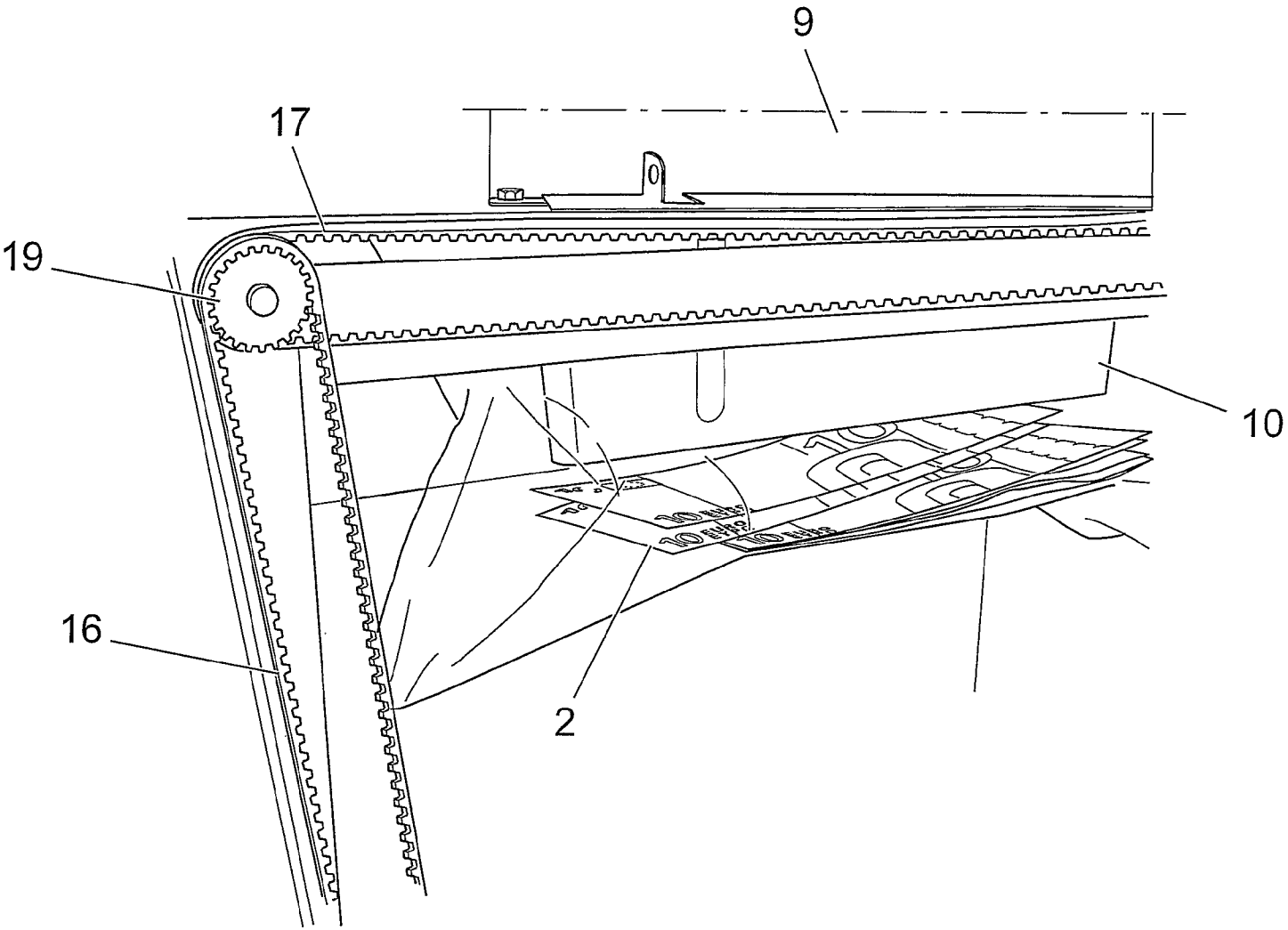

FIG. 3 of the drawings shows a tensioned bag 9 waiting to be transported up to the starting position by the bag holder mechanism when the emptying machine 5 is closed. The bag holder mechanism subsequently permits the downward transport of banknotes 2 to the bottom 9A of the bag, as shown in FIG. 9.

Figure 7:
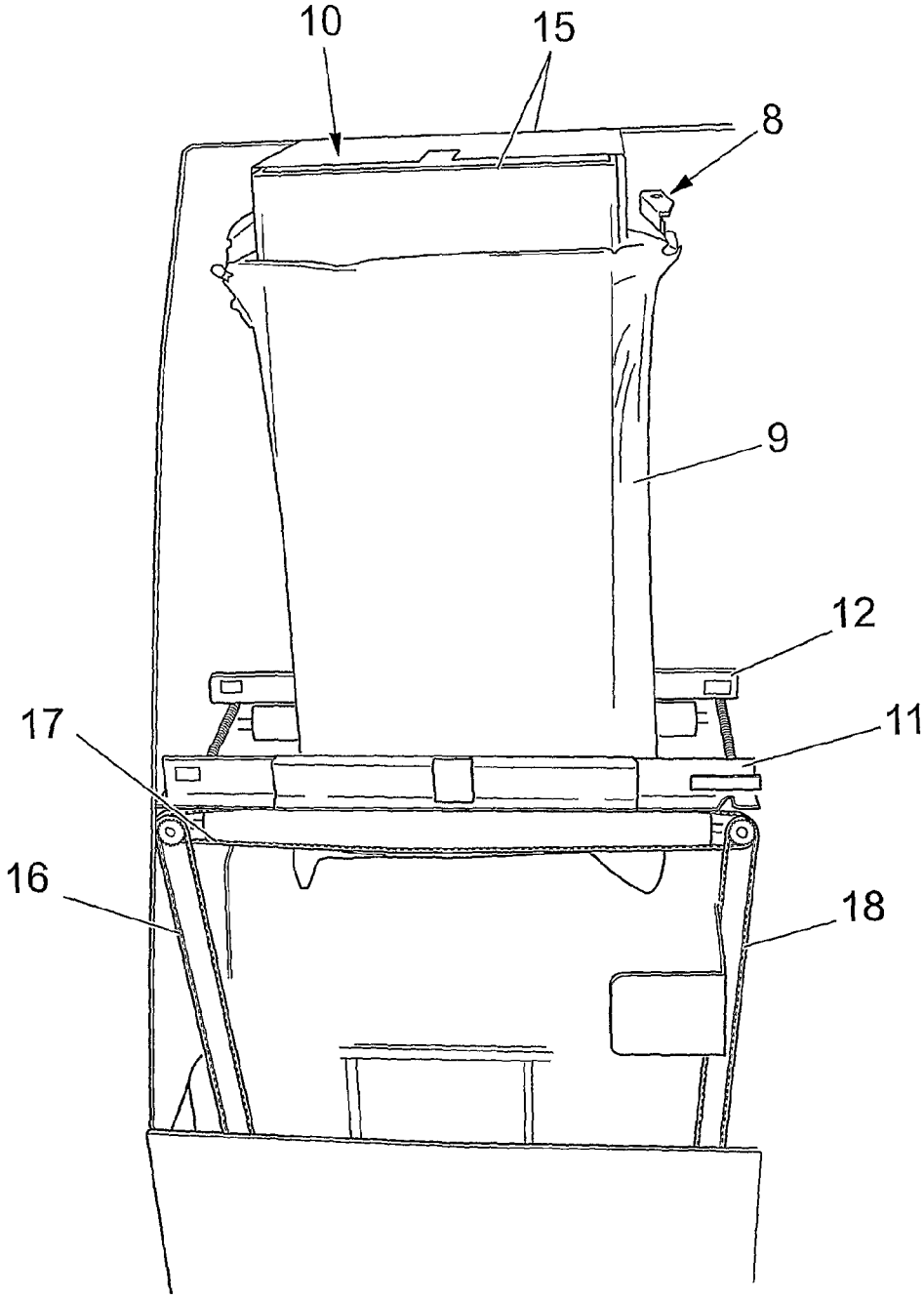
FIGS. 7-8 show the arrangement in various other positions.
Figure 8:
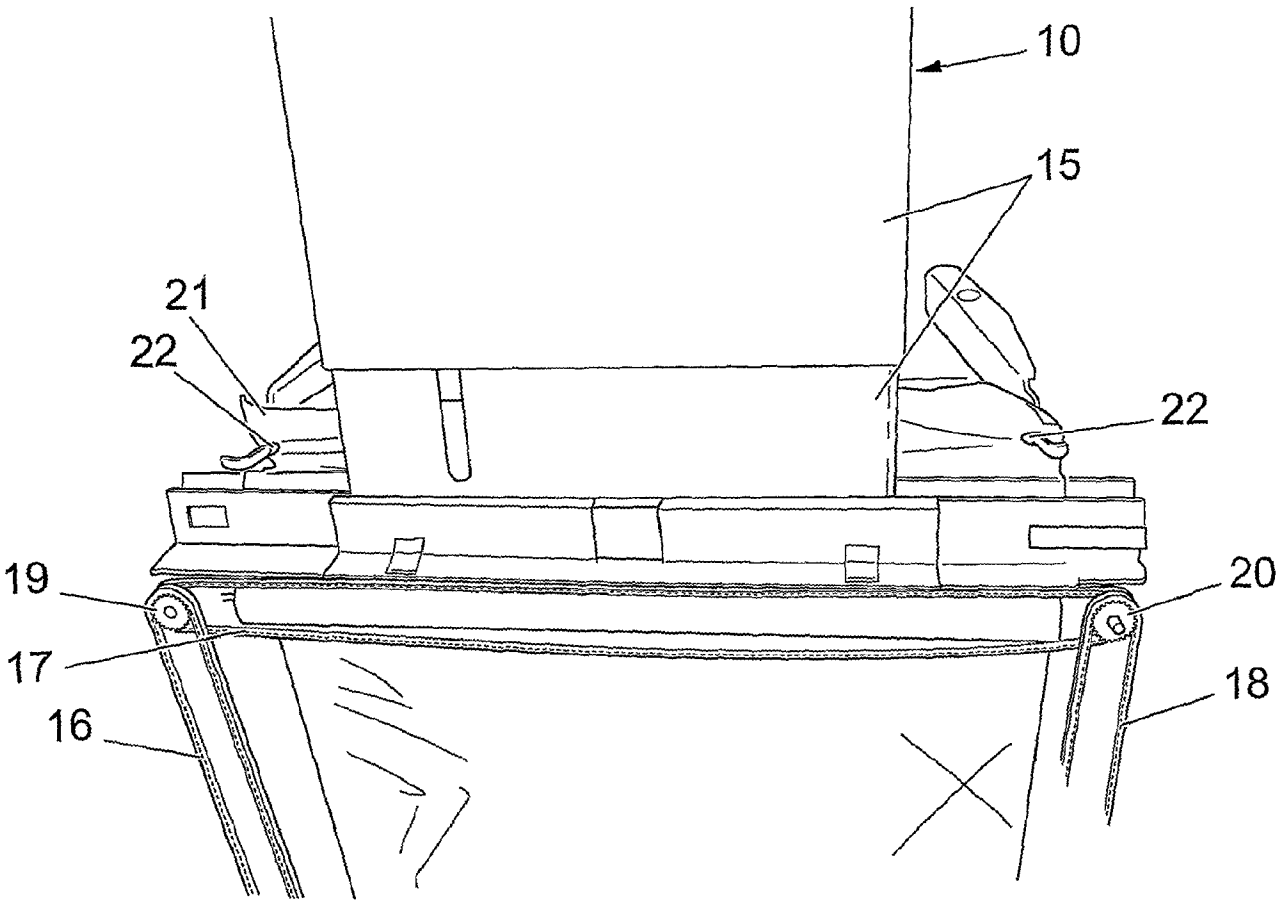

FIG. 7 shows how the pressure rollers of jaws 11, 12 are activated to press the sides of the bag together from the region within the bag 9 where the banknotes 2 are present. At the same time the chute 10 is removed from the interior of the bag. By so doing surplus air is forced out of the bag, so that the bag is easier to handle. By causing the rollers of jaws 11, 12 to be driven in opposite directions, so that the rollers contrarotate in relation to one another, they cause the bag 9 to be drawn down until the upper edge part 9B of the bag reaches the pressure rollers of jaws 11, 12. Once the greatest possible quantity of air has been forced out of the bag 9, the bag is closed, preferably by a known method by using closures 27 provided on the bags 9. The rollers of jaws 11, 12 are moved relative to one another in a direction respectively towards and away from one another, by at least one of them being mounted in such a way as to be displaced along a threaded, rotatably driven feed screw 33 extending between the rollers of jaws 11, 12.

Figure 9:
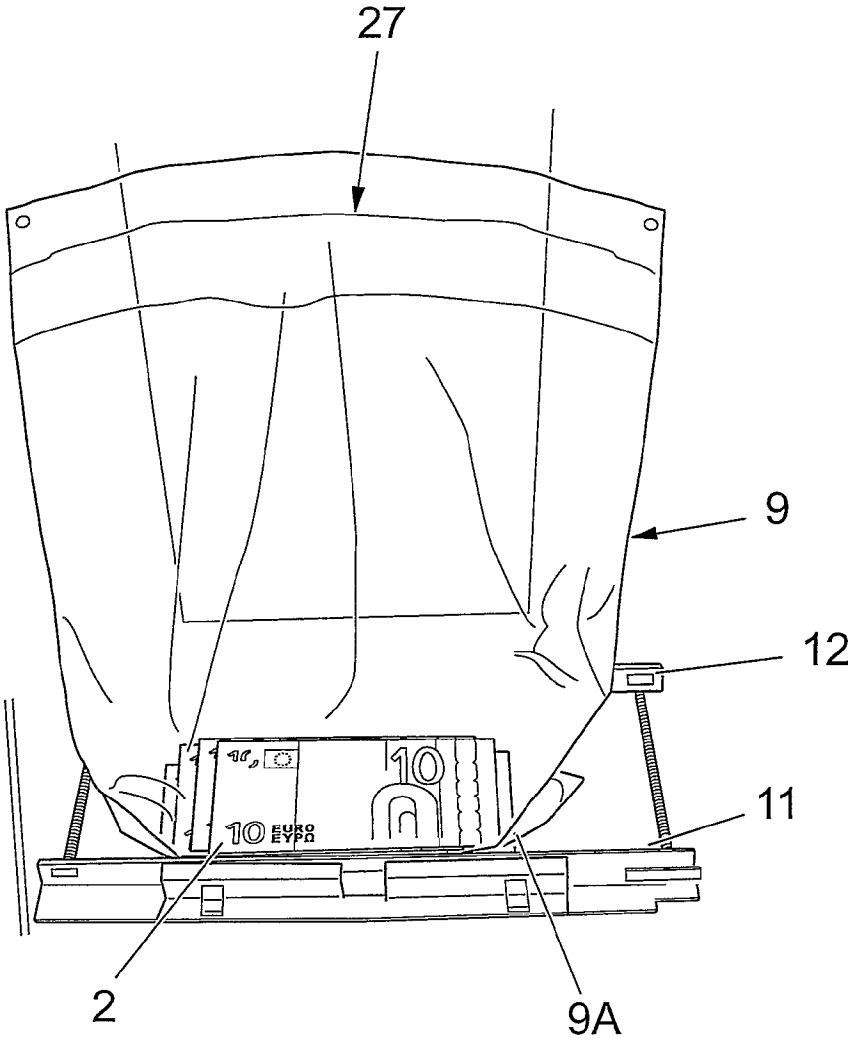
FIGS. 9-10 show a bag filled with banknotes and sealed.
Figure 10:
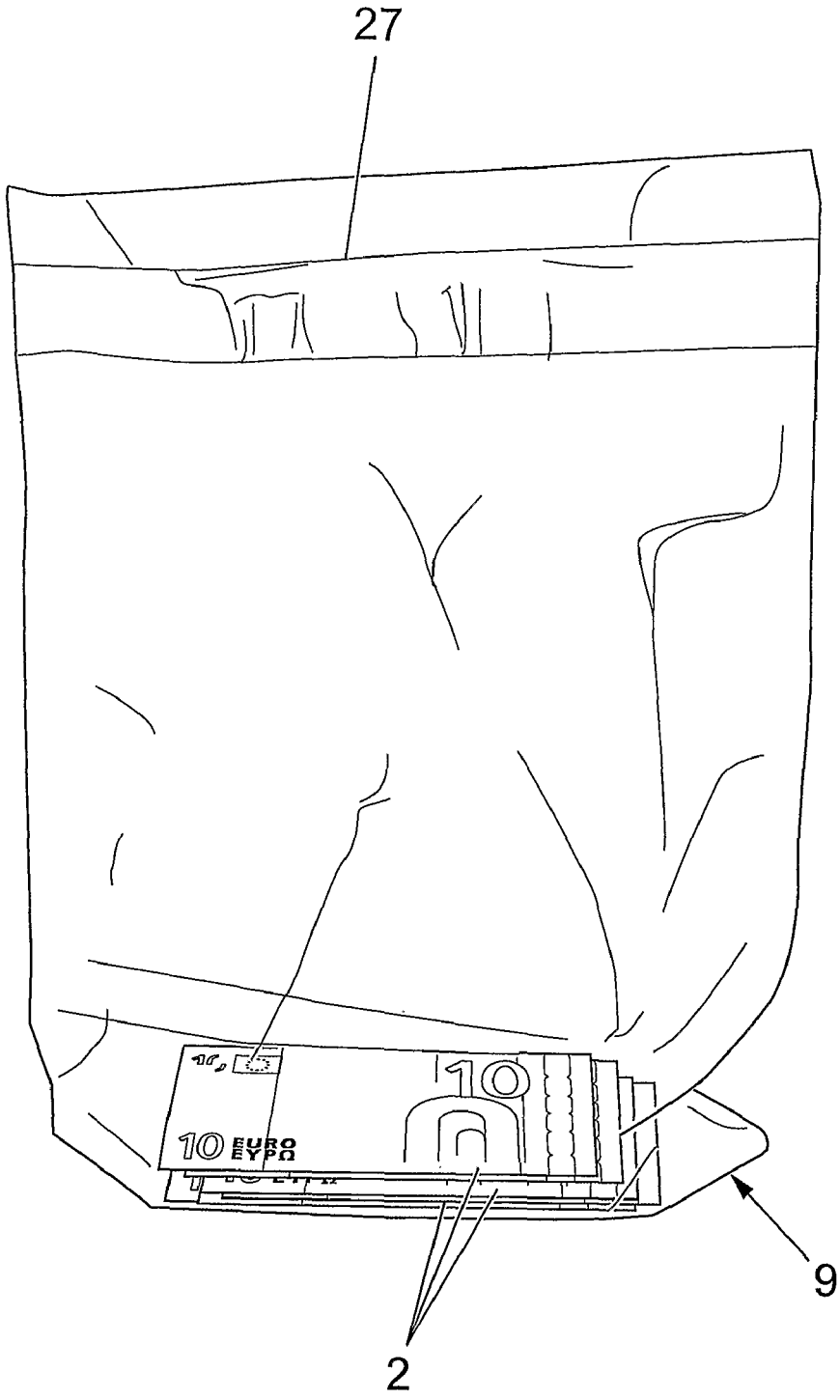

FIGS. 9 and 10 show closed, filled bags. The function of the invention as a whole should have been appreciated clearly from the above description and the illustrations in the drawings.

The invention is naturally not restricted to the embodiments described above and illustrated in the accompanying drawings. Modifications are possible, in particular with regard to the nature of the various parts, or by the use of equivalent technology, but without for that reason departing from the area of protection afforded to the invention, as defined in the appended claims. For example, it is possible to arrange inside the machine a box, in which the sealed, filled bags are collected, for example before the security personnel arrive to collect them for transport to more secure premises, such as a bank.

The invention claimed is:

1. A banknote packing arrangement for packing into a bag banknotes that are contained in a closed cassette, said packing arrangement comprising:

an emptying machine for detachably receiving the cassette containing banknotes;

a path for transferring banknotes from the emptying machine to a packing machine for banknotes;

a bag holder positioned on the packing machine for supporting security bags;

a banknote chute that is displaceable relative to the bag holder for extending internally inside a bag, the chute including a casing;

a pair of jaws movable toward and away from one another are positioned at opposed sides of a bag receiving region of the packing machine, wherein the jaws include elongated rollers opposite one another and are so arranged as to be capable of being driven relative to the bag, wherein the jaw rollers are driven to rotate about respective horizontal axes and to contrarotate in relation to one another so that a bag positioned between the jaw rollers is displaced along the chute in a direction toward the packing machine.

2. A banknote packing arrangement as claimed in claim 1, wherein the chute is of telescopic construction.

3. A banknote packing arrangement as claimed in claim 2, wherein the chute includes pairs of sides and the sides are flat and are substantially parallel to one another.

4. A banknote packing arrangement as claimed in claim 1, wherein the jaws include rubber surface material.

5. A banknote packing arrangement as claimed in claim 1, wherein the bag holder includes bag retaining arms for engaging holes provided in the bag.

6. A banknote packing arrangement as claimed in claim 5, wherein at least one bag retaining arm is pivotally mounted for movement in a direction toward and away from another arm.

7. A banknote packing arrangement as claimed in claim 1, wherein the emptying machine and bag receiving region are enclosed in a lockable cabinet;

a keypad is operatively connected with the cabinet for restricting access to the interior of the cabinet to persons who entered an authorized access identification, and wherein the cassette includes a rotatable winding roller for banknotes and is attached in a lockable fashion to the emptying machine.

8. A banknote packing arrangement for packing into a bag banknotes that are contained in a closed cassette, said packing arrangement comprising:

an emptying machine for detachably receiving the cassette containing banknotes;

a path for transferring banknotes from the emptying machine to a packing machine for banknotes;

a bag holder positioned on the packing machine for supporting security bags;

a banknote chute that is displaceable relative to the bag holder for extending internally inside a bag, the chute including a casing;

a pair of jaws movable toward and away from one another are positioned at opposed sides of a bag receiving region of the packing machine, wherein the jaws include elongated rollers opposite one another and are so arranged as to be capable of being driven relative to the bag, wherein the jaw rollers are driven to contrarotate in relation to one another so that a bag positioned between the jaw rollers is displaced in a direction toward the packing machine, including drive means for rotating the jaw rollers, wherein the drive means include toothed belts and toothed wheels.

9. A banknote packing arrangement as claimed in claim 8, wherein the toothed belts are rubber belts.

* * * * *